US007806231B1

(12) United States Patent
Jackson

(10) Patent No.: US 7,806,231 B1
(45) **Date of Patent: *Oct. 5, 2010**

(54) SAFETY SHIELD

(76) Inventor: Brian Jackson, P.O. Box 1916, Sallisaw, OK (US) 74955

( * ) Notice: Subject to any disclaimer, the term of this patent is extended or adjusted under 35 U.S.C. 154(b) by 405 days.

This patent is subject to a terminal disclaimer.

(21) Appl. No.: 11/973,540

(22) Filed: Oct. 9, 2007

Related U.S. Application Data

(63) Continuation-in-part of application No. 11/442,072, filed on May 26, 2006, now Pat. No. 7,721,848.

(51) Int. Cl.
*B66F 11/00* (2006.01)

(52) U.S. Cl. ..... 182/2.4; 182/47; 182/112; 182/129

(58) Field of Classification Search ..... 182/46, 182/47, 112
See application file for complete search history.

(56) References Cited

U.S. PATENT DOCUMENTS

| | | | | |
|---|---|---|---|---|
| 1,988,435 A | | 1/1935 | Beebe | 173/28 |
| 2,262,394 A | | 11/1941 | Evans | 227/27 |
| 2,576,238 A | | 11/1951 | Rayburn | 24/1 |
| 3,129,470 A | * | 4/1964 | Schneider | 49/450 |
| 3,640,321 A | * | 2/1972 | Walton | 142/55 |
| 3,642,096 A | | 2/1972 | Valentine | 182/46 |
| 3,695,390 A | | 10/1972 | Leigh | 182/129 |
| 3,727,722 A | * | 4/1973 | Hedges et al. | 182/129 |
| 3,917,026 A | * | 11/1975 | Hedges | 182/129 |
| 5,076,635 A | * | 12/1991 | Larkin et al. | 296/146.16 |
| 5,611,410 A | | 3/1997 | Baillargeon | 182/129 |
| 6,361,003 B1 | | 3/2002 | Keoun | 248/213.2 |
| 6,907,894 B1 | | 6/2005 | Bishop | 135/16 |

* cited by examiner

*Primary Examiner*—Alvin C Chin-Shue
(74) *Attorney, Agent, or Firm*—Keisling & Pieper PLC; Meredith K. Lowry

(57) ABSTRACT

The present invention provides a safety shield for installation in an aerial bucket. The safety shield provides an adjustable panel which may be extended to a variety of positions to protect a user from unintentional contact with harmful surfaces such as electrical wires.

15 Claims, 5 Drawing Sheets

SAFETY SHIELD

CROSS-REFERENCE TO RELATED APPLICATIONS

This application claims priority to and is a continuation-in-part of U.S. application Ser. No. 11/442,072, filed May 26, 2006 now U.S. Pat. No. 7,721,848.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to the field of safety devices. In particular, the present invention relates specifically to an electricity shield for linemen.

2. Description of the Known Art

As will be appreciated by those skilled in the art, safety devices are generally employed to prevent collision with a object or substance. In some situations, the offensive object or substance may be harmful or cause harm if contacted. Patents disclosing information relevant to safety devices include U.S. Pat. No. 1,988,435, issued to Beebe on Jan. 22, 1935; U.S. Pat. No. 2,262,394, issued to Evans on Nov. 11, 1941; U.S. Pat. No. 2,576,238, issued to Rayburn on Nov. 27, 1951; U.S. Pat. No. 3,642,096, issued to Valentine on Feb. 15, 1972; U.S. Pat. No. 3,695,390, issued to Leigh on Oct. 3, 1972; U.S. Pat. No. 5,611,410, issued to Baillargeon on Mar. 18, 1997; U.S. Pat. No. 6,361,003, issued to Keoun on Mar. 26, 2002; and U.S. Pat. No. 6,907,894, issued to Bishop on Jun. 21, 2005. Each of these patents are hereby expressly incorporated by reference in their entirety.

U.S. Pat. No. 3,642,096, issued to Valentine on Feb. 15, 1972 entitled Insulating Liner for Man-Carrying Buckets. The abstract provides the following information. A man-carrying bucket for utility trucks in which a man is elevated in the bucket to work on electric powerlines, lamps and the like. The bucket is constructed of molded plastic reinforced with fiberglass and is additionally insulated by a polyethylene liner that is constructed in three pieces, a main portion covering the sidewalls and bottom of the bucket, a top portion that extends up over the top flange of the bucket, and a bottom portion additionally protecting the floor of the bucket. Economy of manufacture is attained by molding the top and bottom portions as a unitary element and then severing the element to provide the top and bottom portions of the liner. The three-piece construction is advantageous from the standpoint of economy in manufacturing and testing of the bucket, and durability and reliability in service.

U.S. Pat. No. 3,695,390, issued to Leigh on Oct. 3, 1972 entitled Aerial Lift with Workman's Basket with Protective Covering. The abstract provides the following information. Aerial lift with workman's basket with protective covering having a boom structure, the outer end of which can be raised and lowered about a horizontal axis, rotated about a vertical axis and moved toward and away from the platform carrying the boom structure. A workman's basket having an upper open end is mounted adjacent the outer end of the boom structure. Support means is secured to the basket and includes an arm which is cantilevered over the upper end of the basket. A removable canopy is provided and means is provided for securing the canopy to the arm so that the canopy overlies and is spaced above the upper open end of the basket and means is provided for removably securing the canopy to the upper end of the basket for enclosing the space between the canopy and the upper end of the basket whereby workmen in the basket can be protected from the sun and inclement weather.

U.S. Pat. No. 5,611,410, issued to Baillargeon on Mar. 18, 1997 entitled Aerial Platform Enclosure Apparatus. The abstract provides the following information. An aerial platform utility enclosure designed to be easily installed upon an unenclosed aerial platform bucket. The enclosure protects the worker from environmental elements without reducing visibility out of the bucket because a polycarbonate plastic such as LEXAN is used to cover the entire enclosure. Upper and lower structural components of the enclosure are constructed out of a non-conductive material. The lower structural component is firmly attached to the bucket while rotation of the upper structure and the protective cover in a full circle allows the worker to have greater access too his surroundings without having to reposition the bucket.

U.S. Pat. No. 6,361,003, issued to Keoun on Mar. 26, 2002 entitled Aerial Bucket Support Apparatus. The abstract provides the following information. An aerial bucket support apparatus is comprised of a contoured support portion, for receiving and supporting an aerial bucket operator, and an attachment portion, for attaching to a wall of the aerial bucket. The aerial bucket support apparatus provides support to an operator when the operator may lean against the aerial bucket walls, providing more comfort and providing additional safety. The aerial bucket support apparatus can also include a recessed portion for housing tools.

Thus, it may be seen that these prior art patents are very limited in their teaching and utilization, and an improved safety device is needed to overcome these limitations.

SUMMARY OF THE INVENTION

The present invention is directed to an improved safety shield device for installation and use within an aerial bucket. As will be appreciated by those skilled in the art, individuals who work within the confines of an aerial bucket are periodically placed in life-threatening situations caused by the close proximity of electrical lines or while energizing equipment. Additionally, these individuals are placed in the elements at the mercy of the weather conditions while they work.

A need exists for a safety device which can be employed by aerial workers to protect them from the accidental contact with harmful surfaces or from harmful contact due to defective equipment. A need also exists to shield workers from the weather. Therefore, it is an object of the present invention to provide an insulated shield which is easily installed within an aerial bucket or built into the liner of the aerial bucket during manufacture.

It is an object of the present invention to provide a shield which is easily adjusted within an aerial bucket to protect a worker from harmful contact with dangerous surfaces or from the effects of defective equipment or equipment malfunction.

It is an additional object of the present invention to provide a shield which is easily adjusted within an aerial bucket to shield a worker from unwanted contact with weather elements.

It is further object of the present invention to provide a shield which can be positioned at multiple heights.

It is an object of the present invention to provide a shield which can be easily retracted to allow a worker to access the area behind the shield.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
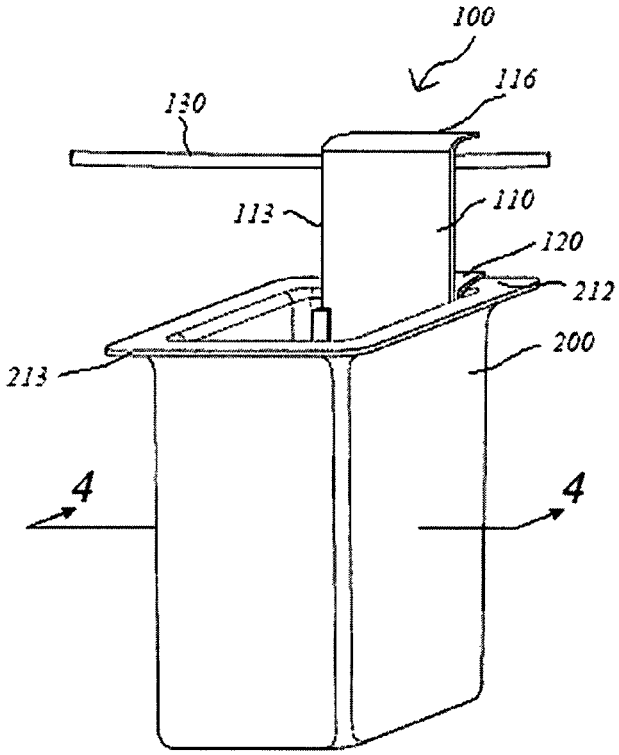
FIG. 1 is an environmental view of an extended safety shield.

As shown in FIG. 1 of the drawings, one exemplary embodiment of the present invention is generally shown as a shield 100 for installation and use in an aerial bucket. As will be appreciated by those skilled in the art, aerial buckets are frequently used by linemen, utility workers, fruit harvesters, and other such individuals who are involved with retrieving or modifying high-altitude objects. As contemplated by the present invention, the shield 100 is suitable for mounting in an aerial bucket 200 for use by an individual to protect the individual from contacting harmful surfaces or harsh weather. The shield 100 is further suitable for permanently mounting within the liner of an aerial bucket 200.

Figure 7:
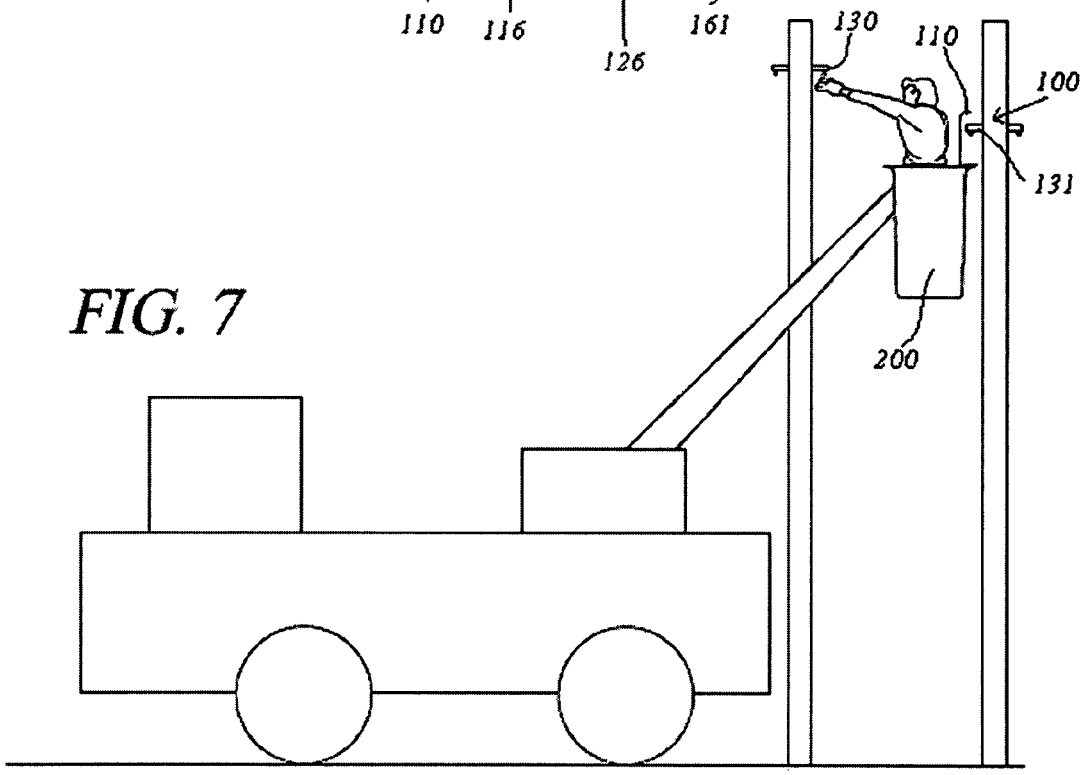
FIG. 7 is an environmental view of the extended safety shield.
Figure 8:
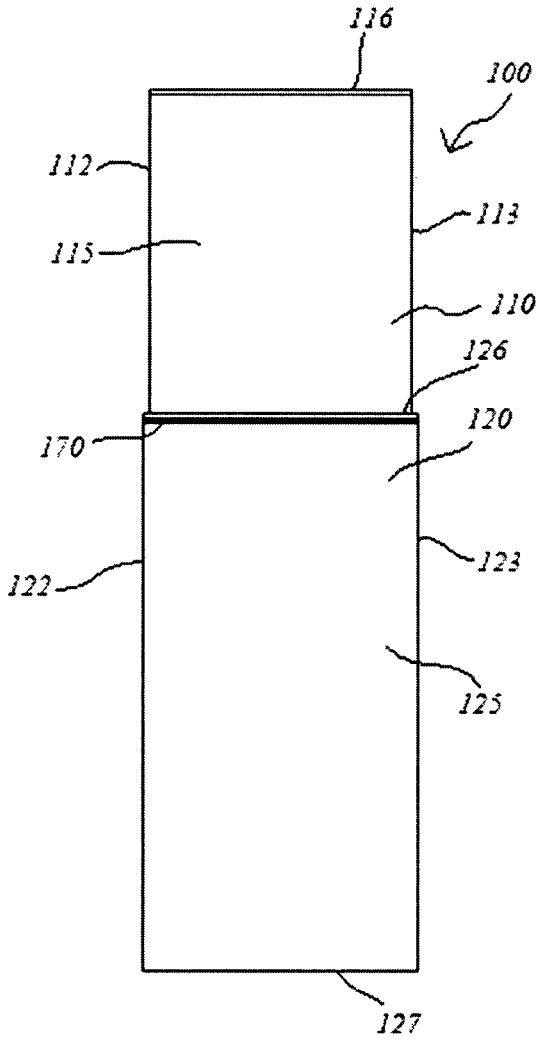
FIG. 8 is a rear plan view of the extended safety shield.
Figure 9:
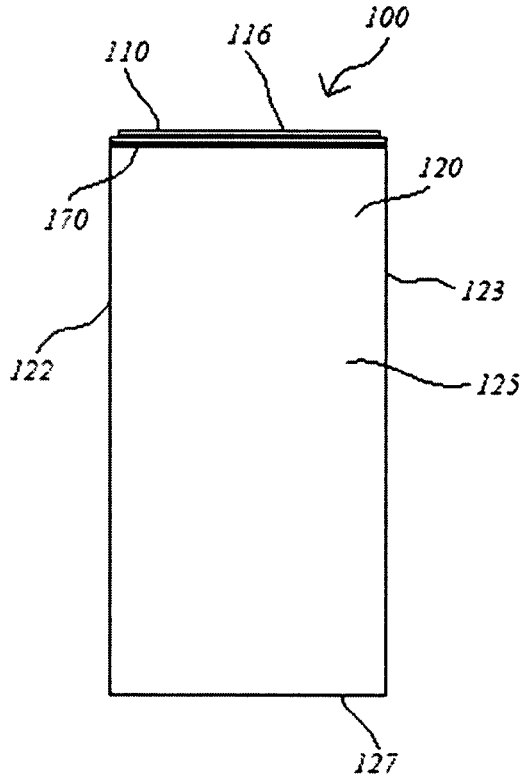
FIG. 9 is a rear plan of the safety shield.
Figure 10:
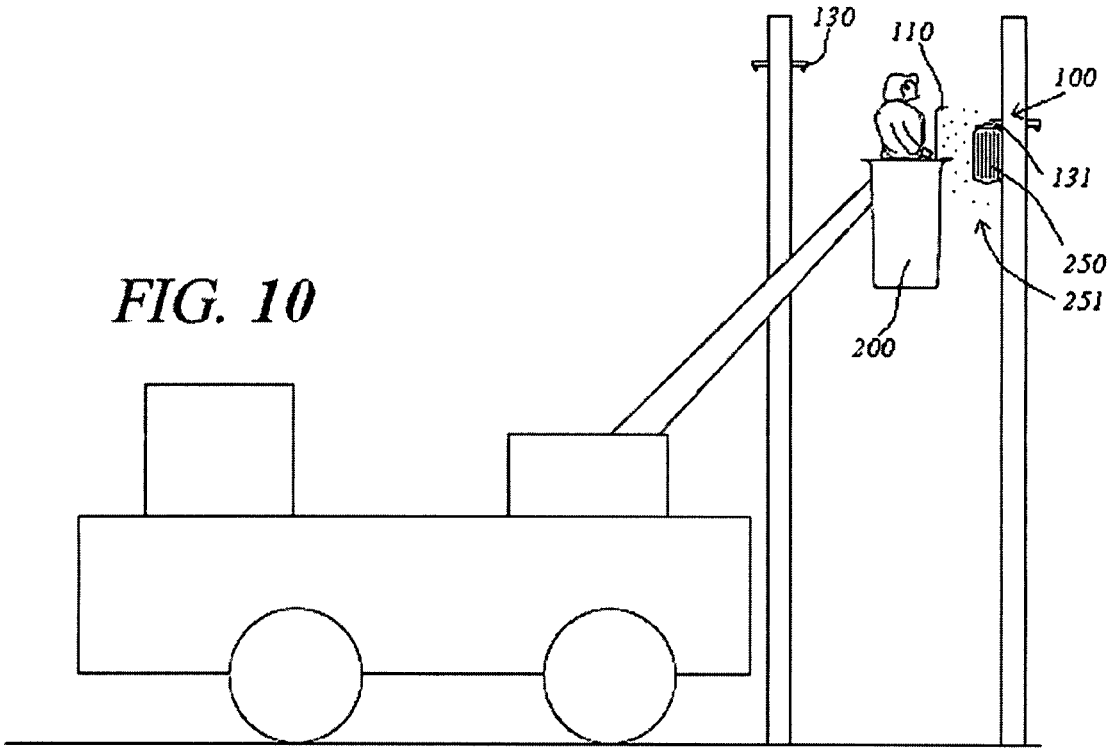
FIG. 10 is an environmental view of the extended safety shield.

As shown in FIG. 1 and FIG. 7, the shield 100 is adapted to be installed in an aerial bucket 200 to be extended to a variety of heights depending upon the requirements of the user. In this manner, the shield 100 protects the user from unintentional contact with harmful surfaces such as electrical wires. As will be appreciated by one skilled in the art, typical work for utility workers and other aerial workers involves working between electrical wires. This situation is typically called being between the phases. Accidents occur between the phases when an aerial worker contacts more than one electrical wire unintentionally. A common scenario involves a worker accessing one electrical wire 130 intentionally to conduct work while unintentionally extending into another electrical wire 131. The present invention is designed to minimize the likelihood of contacting more than one electrical wire by shielding a worker from the other wires. Further, the shield 100 may be used to protect a user from burning material or debris thrown into the air caused by equipment malfunctioning. Utility workers and other aerial workers are placed in close proximity to transformers 250 on a regular basis. In some situations, the utility workers are required to energize equipment, which can cause a transformer 250 to malfunction, spraying burning oil and other debris 251 into the air. The present invention is designed to minimize the likelihood of contacting this burning debris 251 by shielding a worker.

It is further contemplated that the shield 100 can be utilized to shelter an aerial worker from the weather. Aerial workers commonly continue work during rainstorms, snowstorms, hail, and harsh wind. These harsh conditions can negatively impact the efficiency of the work done in the aerial bucket. The shield 100 may be extended to provide shelter from vertically moving precipitation and wind. In this manner, the aerial worker can more efficiently and accurately continue his work.

The shield 100 consists generally of an adjustable panel 110, an exterior sleeve 120, multiple locking tracks 140, multiple locking ports 150, multiple locks 160, an attaching fastener 170. Each of these will be discussed in turn.

The shield 100 includes an adjustable panel 110 adapted to move vertically to protect and shelter aerial workers from unwanted contact. The adjustable panel 110 is composed of an dielectric material such as polyethylene, polyurethane or fiberglass. The adjustable panel 110 generally has a right 112 and left vertical side 113, a front 114 and rear side 115, and a top lip 116 and bottom edge 117. The top lip 116 of the adjustable panel 110 curves along the curve of the upper lip 212 of the aerial bucket 200. The curved top lip 116 eliminates sharp edges from the upper portion of the adjustable, panel while providing a surface easily grasped to extend the adjustable panel upwards.

The adjustable panel 110 is adapted to fit and move vertically within the exterior sleeve 120 along the vertical axis of the exterior sleeve 129 and the adjustable panel 119. In another embodiment, the adjustable panel 110 may be housed within a wall 210 of an aerial bucket 200. The adjustable panel 110 is formed to fit and conform to the wall 210 of an aerial bucket 200. In another embodiment, the adjustable panel 110 conforms to the wall 210 and corners 211 of the aerial bucket 200. In this manner, the adjustable panel 110 is adapted to prevent contact with harmful surfaces present by the corners 211 of the aerial bucket 200. In another embodiment, the adjustable panel 111 can be restricted to the shape of the corners 211 of the aerial bucket 200. These corner adjustable panels 111 may be used independently or in conjunction with the side adjustable panels 111 to prevent accidental contact outside of the aerial bucket 200. The exterior sleeve 120 generally houses the adjustable panel 110, the multiple locking tracks 140, 141, and the attaching fastener 170. The exterior sleeve 120 is composed of an insulating material such as fiberglass. The exterior sleeve 120 generally has a right 122 and left vertical side 123, a front 124 and rear side 125, and a top lip 126 and bottom edge 127. The top lip 126 of the exterior sleeve 120 curves along the curve of the upper lip 212 of the aerial bucket 200. In a preferred embodiment, the upper lip 212 may include an L-shaped lip 171 at the edge of the lip 212. The L-shaped lip 171 is adapted to secure the exterior sleeve 120 around the upper lip 212 and upper edge 213 of the aerial bucket 200. The curved top lip 126 eliminates sharp edges from the upper portion of the exterior panel 120 while providing a surface easily grasped to extend the adjustable panel upwards. The exterior sleeve 120 has a tool panel 118 formed to the front 124 of the panel 120 or the front side 170 of the rear side 125. The tool panel 118 is similarly composed of a dielectric material and is suitable for hanging tools within reach of the user. The tool panel 118 may consist of a variety of attachment means, such as a hook, a bracket, or a c-shaped projection. The tool panel 118 may have one attachment port 119 or multiple ports.

Figure 2:
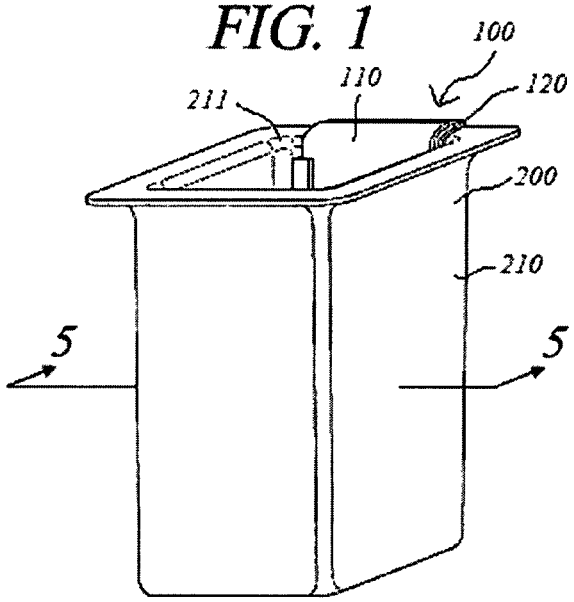
FIG. 2 is an environmental view of the safety shield.
Figure 4:
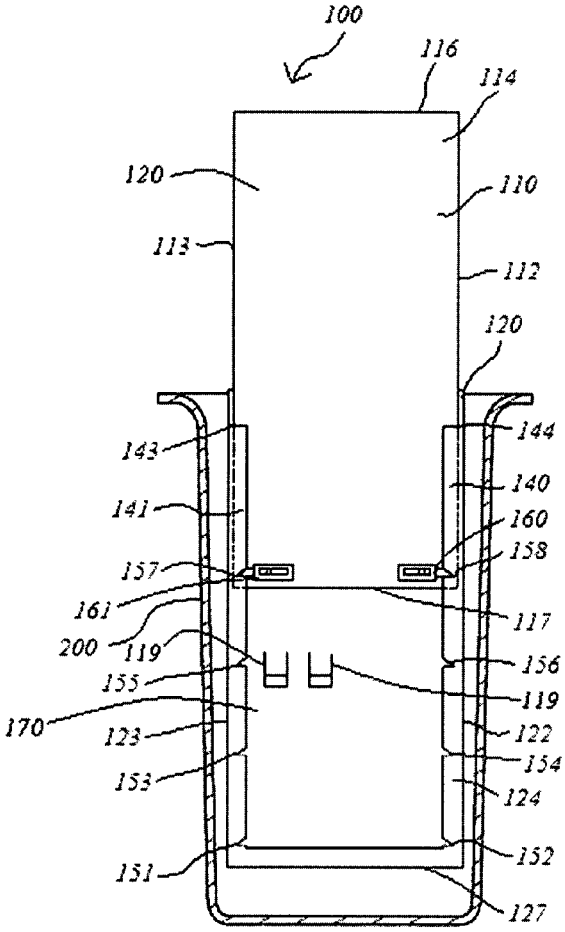
FIG. 4 is a front plan view of the extended safety shield along line 4-4.
Figure 5:
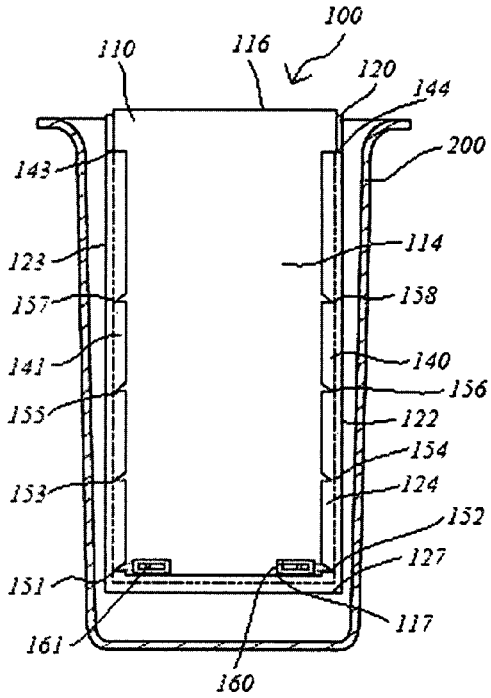
FIG. 5 is a front plan view of the safety shield along line 5-5.

The front side 124 of the exterior sleeve 120 includes multiple locking tracks 140, 141 positioned proximate the right 122 and left sides 123 of the exterior sleeve 120. The multiple locking tracks 140, 141 include multiple locking ports 150 to allow a user to extend the shield 100 to a variety of heights. The positions allow for a retracted position, shown in FIGS. 2 and 5, multiple intermediate positions, shown in FIG. 1, and an extend position, shown in FIG. 4. In the retracted position, two locking ports 151, 152 are located proximate the bottom edge 127 of the exterior sleeve 120. In the intermediate positions, multiple locking ports 153, 154, 155, 156 are located above the retracted locking ports 151, 152 posterior to the top edges 143, 144 of the locking tracks 140, 141. In the extended position, multiple locking ports 157, 158 are located proximate the top edges 143, 144 of the locking tracks 140, 141.

The multiple locking ports 150 are engaged by multiple locks 160, 161 attached to the adjustable panel 110. The multiple locks 160, 161 are adapted to be easily engaged to move from a locked position within a locking port 150 to an unlocked position to allow for the vertical movement of the adjustable panel 110. The locked position of the multiple locks 160, 161, or one of the multiple locks, prevents the vertical movement of the adjustable panel 110. In this manner, the shield 100 will remain in an extended or partially extended position until a user wishes to retract the shield 100. The multiple locks 160, 161 can be utilize a number of locking mechanisms, such as a bolt system or a spring-loaded latch design. Further, other locking mechanisms which utilize an extending bolt or other extending member which can be used to engage the multiple locking ports 150 may be employed.

Figure 3:
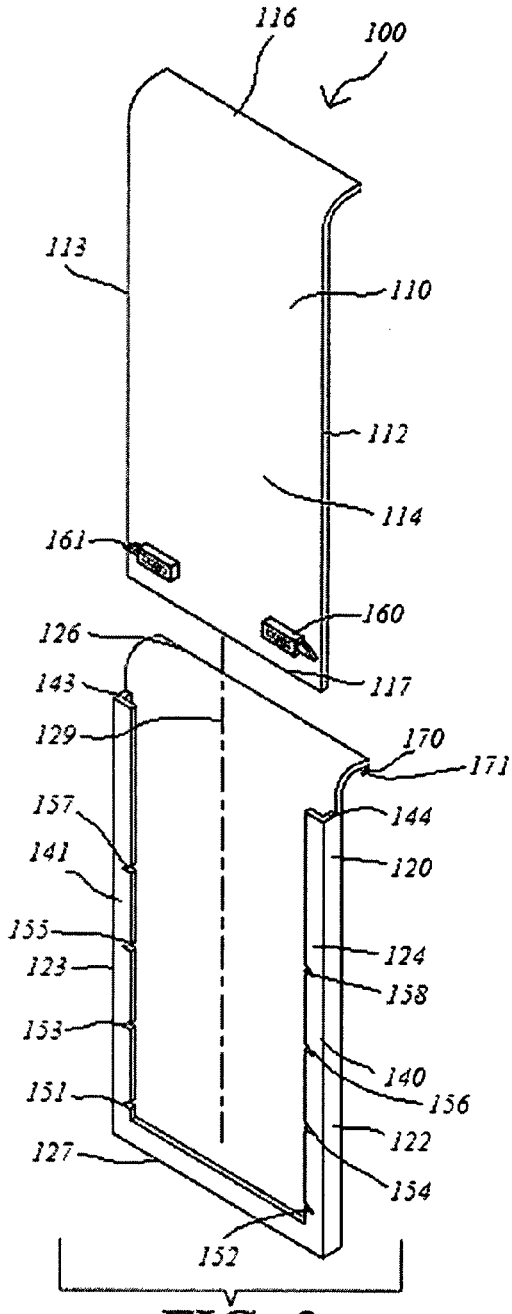
FIG. 3 is a perspective view of the safety shield.

As shown in FIG. 3 and discussed above, the exterior sleeve 120 may be attached to an aerial bucket by utilizing an L-shaped lip 171. In alternative embodiments, the exterior sleeve 120 may be attached to the aerial bucket 200 by a variety of attaching fasteners 170, such as adhesives, screws, bolts, or clamps. Other similar attachment means are also envisioned. Preferably, the attaching fastener 170 is positioned along the top lip 126 of the exterior sleeve 120 connecting the exterior sleeve 120 to the upper lip 212 of the aerial bucket 200.

Figure 6:
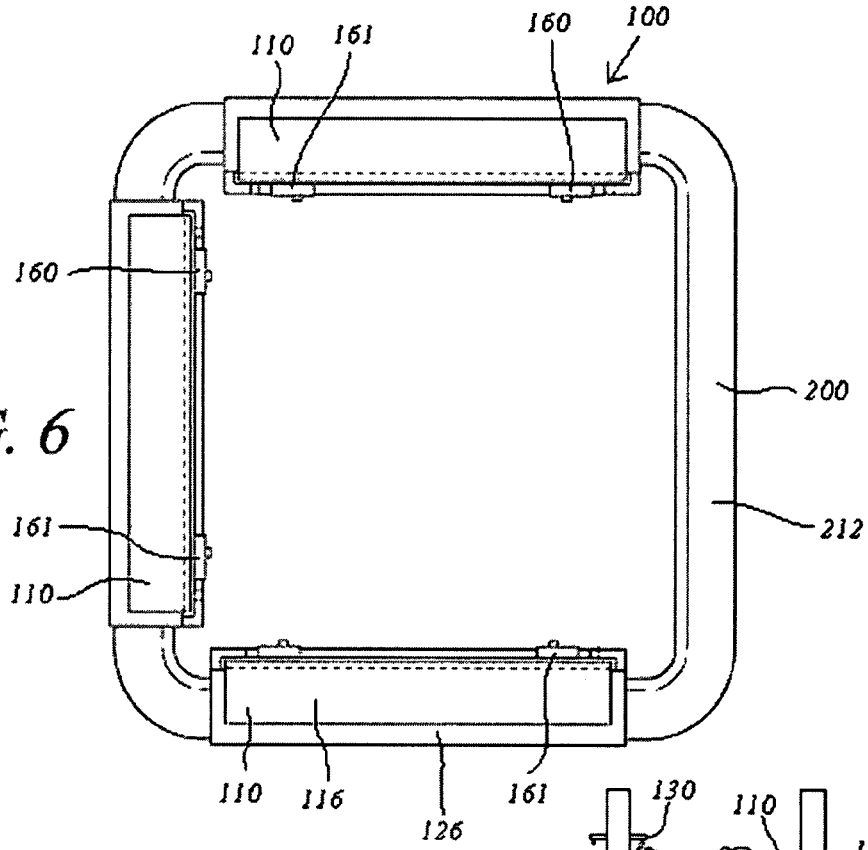
FIG. 6 is a top elevational view of the safety shield.

As shown in FIG. 6, it is envisioned that more than one shield 100 may be employed to protect an aerial worker. In this manner, the aerial worker may extend any one or more of the attached shields 100 depending upon the location of the harmful surfaces while still allowing for access to electrical lines 130 or other desired objects.

Reference numerals used throughout the detailed description and the drawings correspond to the following elements:

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

When interpreting the claims of this application, method claims may be recognized by the explicit use of the word 'method' in the preamble of the claims and the use of the 'ing' tense of the active word. Method claims should not be interpreted to have particular steps in a particular order unless the claim element specifically referring to a previous element, a previous action, or the result of a previous action. Apparatus claims may be recognized by the use of the word 'apparatus' in the preamble of the claim and should not be interpreted to have 'means plus function language' unless the word 'means' is specifically used in the claim element. The words 'defining, ' 'having,' or 'including' should be interpreted as open ended claim language that allows additional elements or structures.

What is claimed is:

1. A shield for installation in an aerial bucket used proximate harmful objects or during harsh weather, the shield comprising:

an adjustable panel composed of a dielectric material;

an exterior sleeve housing said adjustable panel, said exterior sleeve having a vertical axis, a tool attachment port, and an attachment lip securing around the upper edge of the side of the aerial bucket;

at least one locking track having at least one locking port;

at least one lock connected to said adjustable panel for engaging said at least one locking port;

whereas said panel is adapted to move within said exterior sleeve along said vertical axis of said exterior sleeve to an extended position and held in said extended position by engaging said at least one lock into said at least one locking port so that a user of said shield is sheltered from contact with harmful objects, debris or harsh weather.

2. The shield of claim 1, wherein said at least one lock consists of a spring-loaded latch.

3. The shield of claim 1, wherein said at least one locking track is positioned proximate to a vertical side of said adjustable panel.

4. The shield of claim 1, wherein said at least one locking track is positioned proximate to both vertical sides of said adjustable panel.

5. The shield of claim 1, wherein said attachment lip is an L-shaped structure fitting around the top edge of the aerial bucket.

6. The shield of claim 1, said exterior sleeve having multiple tool attachment ports.

7. The shield of claim 6, wherein said panel is adapted to move within said exterior sleeve to at least one partially extended position and held in said at least one partially extended position by engaging said at least one lock into said at least one intermediate locking port.

8. A shield for installation in an aerial bucket for work near harmful objects or during harsh weather, the shield comprising:

an adjustable panel composed of a dielectric material selected from a list including polyethylene, polyurethane and fiberglass;

an exterior sleeve housing said adjustable panel, said exterior sleeve having a vertical axis, an L-shaped attachment lip securing around the upper edge of the side of the aerial bucket and means for attaching items to said exterior sleeve;

at least one locking track positioned proximate to a vertical side of said adjustable panel and having at least one locking port;

at least one lock connected to said adjustable panel for engaging said at least one locking port;

at least one fastener for securing said exterior sleeve to an aerial bucket wherein said at least one fastener is connected to said exterior sleeve;

whereas said panel is adapted to move within said exterior sleeve along said vertical axis of said exterior sleeve to an extended position and held in said extended position by engaging said at least one lock into said at least one locking port so that a user of said shield is protected from contact with harmful objects, debris or harsh weather.

9. The shield of claim 8, wherein said at least one locking track is positioned proximate to a vertical side of said adjustable panel.

10. The shield of claim 8, wherein said at least one locking track is positioned proximate to both vertical sides of said adjustable panel.

11. The exterior sleeve of claim 8, wherein said at least one locking track further includes at least one intermediate locking port.

12. The shield of claim 11, wherein said panel is adapted to move within said exterior sleeve to at least one partially extended position and held in said at least one partially extended position by engaging said at least one lock into said at least one intermediate locking port.

13. A shield for protecting individuals from contacting harmful objects or during harsh weather, the shield comprising:

an adjustable panel;

an exterior sleeve housing said adjustable panel, said exterior sleeve having a vertical axis, a tool attachment port, and an L-shaped attachment lip installed on an upper edge of a side of an aerial bucket;

at least one locking track positioned proximate to a vertical side of said adjustable panel and having at least one locking port;

at least one lock connected to said adjustable panel for engaging said at least one locking port;

said panel adapted to move within said exterior sleeve along said vertical axis of said exterior sleeve to an extended position above said exterior sleeve and held in said extended position by engaging said at least one lock into said at least one locking port so that a user of said shield is protected from contact with harmful objects, debris or harsh weather.

14. The exterior sleeve of claim 13, wherein said at least one locking track further includes at least one intermediate locking port.

15. The shield of claim 13, wherein said panel is adapted to move within said exterior sleeve to at least one partially extended position and held in said at least one partially extended position by engaging said at least one lock into said at least one intermediate locking port.

* * * * *